US009390648B2

(12) United States Patent
Lee et al.

(10) Patent No.: US 9,390,648 B2
(45) Date of Patent: Jul. 12, 2016

(54) PIXEL AND ORGANIC LIGHT EMITTING DISPLAY USING THE SAME

(71) Applicant: Samsung Display Co., Ltd., Yongin, Gyeonggi-do (KR)

(72) Inventors: Chang-Ho Lee, Yongin (KR); Yang-Wan Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 337 days.

(21) Appl. No.: 13/707,372

(22) Filed: Dec. 6, 2012

(65) Prior Publication Data

US 2014/0062982 A1 Mar. 6, 2014

(30) Foreign Application Priority Data

Aug. 31, 2012 (KR) ..... 10-2012-0096306

(51) Int. Cl.
*G09G 3/32* (2006.01)

(52) U.S. Cl.
CPC ..... *G09G 3/3208* (2013.01); *G09G 3/3233* (2013.01); *G09G 2300/0819* (2013.01); *G09G 2300/0842* (2013.01); *G09G 2300/0861* (2013.01); *G09G 2310/0262* (2013.01); *G09G 2320/043* (2013.01)

(58) Field of Classification Search
CPC . G09G 3/3659; G09G 3/3233; G09G 3/3208; G09G 2300/0819; G09G 2300/0861; G09G 2320/043; G09G 230/0842
See application file for complete search history.

(56) References Cited

U.S. PATENT DOCUMENTS

| | | | | |
|---|---|---|---|---|
| 8,692,821 | B2 * | 4/2014 | Park | G09G 3/3233 345/211 |
| 2005/0017934 | A1 | 1/2005 | Chung et al. | |
| 2008/0036371 | A1 * | 2/2008 | Kim | G09G 3/3233 313/504 |
| 2008/0211397 | A1 * | 9/2008 | Choi | G09G 3/3233 313/504 |
| 2012/0019504 | A1 | 1/2012 | Han et al. | |
| 2012/0038605 | A1 * | 2/2012 | Han | 345/211 |
| 2012/0038683 | A1 * | 2/2012 | Park | G09G 3/3233 345/690 |
| 2014/0168180 | A1 * | 6/2014 | Kim | H05B 33/0896 345/205 |

FOREIGN PATENT DOCUMENTS

| | | |
|---|---|---|
| KR | 10-2005-0005646 A | 1/2005 |
| KR | 10-2012-0009669 A | 2/2012 |
| KR | 10-2012-0015076 A | 2/2012 |

* cited by examiner

*Primary Examiner* — Ilana Spar
*Assistant Examiner* — Mihir Rayan
(74) *Attorney, Agent, or Firm* — Knobbe, Martens, Olson & Bear, LLP

(57) ABSTRACT

A pixel capable of realizing desired brightness and of displaying a uniform image is disclosed. In one aspect, the pixel includes an organic light emitting diode (OLED), a first transistor having a second electrode thereof coupled to an anode electrode of the OLED to control an amount of current supplied to the OLED in response to a voltage applied to a gate electrode thereof. The pixel also includes at least one second transistor coupled between the second electrode and the gate electrode of the first transistor, and a third transistor coupled between the second transistor and the gate electrode of the first transistor. The third transistor is turned off in a partial period of a period in which the second transistor is turned on.

12 Claims, 3 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2012-0096306, filed on Aug. 31, 2012, in the Korean Intellectual Property Office, the entire content of which is incorporated herein by reference.

BACKGROUND

1. Field

The described technology generally relates to a pixel and an organic light emitting display using the same.

2. Description of the Related Technology

Recently, various flat panel displays (FPD) have been developed. The FPDs include liquid crystal displays (LCD), field emission displays (FED), plasma display panels (PDP), and organic light emitting diode (OLED) displays.

OLED displays display images using an OLED that generate light by re-combination of electrons and holes. OLED displays generally have high response speed and reduced power consumption.

SUMMARY

One inventive aspect is a pixel capable of realizing desired brightness and of displaying a uniform image and an organic light emitting display using the same.

Another aspect is a pixel, including an organic light emitting diode (OLED), a first transistor having a second electrode thereof coupled to an anode electrode of the OLED to control an amount of current supplied to the OLED to correspond to a voltage applied to a gate electrode thereof, at least one second transistor coupled between the second electrode and the gate electrode of the first transistor, and a third transistor coupled between the second transistor and the gate electrode of the first transistor. The third transistor is turned off in a partial period of a period in which the second transistor is turned on.

The third transistor may be turned on at timing when the second transistor may be turned on. The third transistor may be turned off before the second transistor is turned off. The third transistor may be turned on after the second transistor is turned off. The pixel further includes a fourth transistor coupled between a data line and the first electrode of the first transistor and simultaneously turned on and off with the second transistor, a fifth transistor coupled between the first electrode of the first transistor and a first power supply and turned off in a period where the second transistor is turned on, a sixth transistor coupled between the second electrode of the first transistor and the OLED and simultaneously turned on and off with the fifth transistor, a seventh transistor coupled between an initializing power supply and the gate electrode of the first transistor and turned on prior to the second transistor, and a storage capacitor coupled between the gate electrode of the first transistor and the first power supply.

Another aspect is an organic light emitting display, including a scan driver for driving scan lines and emission control lines, a data driver for driving data lines, and pixels positioned at intersections of the scan lines and the data lines. Each of the pixels positioned in an ith (i is a natural number) horizontal line includes an OLED, a first transistor having a second electrode thereof coupled to the OLED to control an amount of current supplied to the OLED to correspond to a voltage applied to a gate electrode thereof, a second transistor coupled between the second electrode and the gate electrode of the first transistor and turned on when a scan signal is supplied to an ith scan line, and a third transistor coupled between the second transistor and the gate electrode of the first transistor, turned off when an emission control signal is supplied to an (i+2)th emission control line, and turned on in the other cases.

The scan driver supplies an emission control signal to an ith emission control line to overlap scan signals supplied to (i−1) th and ith scan lines. The scan driver supplies the emission control signal to the (i+2)th emission control line to overlap the scan signal supplied to the ith scan line in a partial period. The turn on period of the third transistor partially overlaps the turn on period of the second transistor to correspond to the emission control signal supplied to the (i+2)th emission control line. The third transistor is turned off before the second transistor is turned off. The third transistor is turned on after the second transistor is turned off.

Each of the pixels positioned in the ith horizontal line includes a fourth transistor that is coupled between the data line and the first electrode of the first transistor and whose gate electrode is coupled to the ith scan line, a fifth transistor that is coupled between the first electrode of the first transistor and a first power supply and whose gate electrode is coupled to the ith emission control line, a seventh transistor that is coupled between an initializing power supply and the gate electrode of the first transistor and whose gate electrode is coupled to the (i−1)th scan line, and a storage capacitor coupled between the gate electrode of the first transistor and the first power supply. The initializing power supply is set to have a lower voltage than the data signal supplied to the data line.

DETAILED DESCRIPTION

Figure 1:
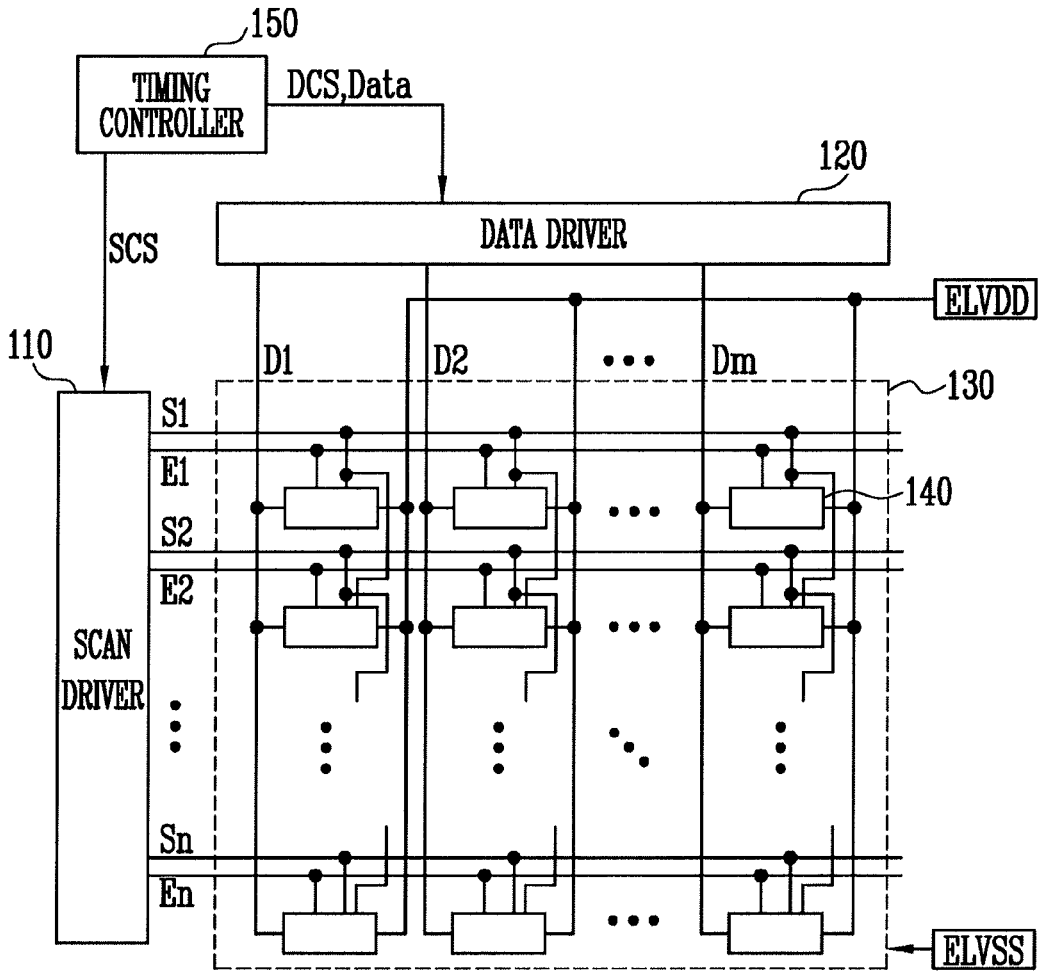
FIG. 1 is a view illustrating an organic light emitting display according to an embodiment.

An OLED display generally includes a plurality of pixels arranged at intersections of a plurality of data lines, scan lines, and power supply lines in a matrix. Each of the pixels commonly includes an OLED, at least two transistors including a driving transistor, and at least one capacitor.

The OLED display has an advantage of reduced power consumption, however, has a disadvantage in that an amount of current that flows to the OLEDs changes in accordance with deviation in the threshold voltages of the driving transistors included in the pixels, causing non-uniform display. That is, the characteristics of the driving transistors change in accordance with the manufacturing process variables of the driving transistors. Actually, it is not possible to manufacture an OLED display which has all of its transistors with the same current characteristics, which results in the deviation in the threshold voltages of the driving transistors.

There is a method of adding compensating circuits each formed of a plurality of transistors and a capacitor to the pixels, respectively. The compensating circuits couple the driving transistors in the form of diodes in a period where scan signals are supplied to compensate for the deviation in the threshold voltages of the driving transistors. Here, in order to secure driving stability, a plurality of transistors are added between the gate electrode and the drain electrode of a driving transistor in order to couple the driving transistor in the form of a diode.

The transistors are generally turned off after a predetermined voltage is charged in the storage capacitor. Here, the voltage charged in the storage capacitor changes due to a kickback voltage generated when the transistors are turned off. In this case, the pixels do not display an image with desired brightness. In addition, when the characteristics of the transistors included in each of the pixels are different from each other, a non-uniform image is displayed on a panel.

Hereinafter, embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the present disclosure are omitted for clarity. Also, like reference numerals refer to like elements throughout.

Hereinafter, a pixel and an organic light emitting display using the same will be described in detail as follows with reference to FIGS. 1 to 4.

FIG. 1 is a view illustrating an organic light emitting display according to an embodiment.

Referring to FIG. 1, the organic light emitting display includes a pixel unit 130 including pixels 140 positioned at the intersections of scan lines S1 to Sn and data lines D1 to Dm, a scan driver 110 for driving the scan lines S1 to Sn and emission control lines E1 to En, a data driver 120 for driving the data lines D1 to Dm, and a timing controller 150 for controlling the scan driver 110 and the data driver 120.

The timing controller 150 generates a data driving control signal DCS and a scan driving control signal SCS in response to synchronizing signals supplied from the outside of the organic light emitting display. The data driving control signal DCS and the scan driving control signal SCS generated by the timing controller 150 are supplied to the data driver 120 and the scan driver 110, respectively. The timing controller 150 supplies data (Data) provided from the outside of the organic light emitting display to the data driver 120.

The scan driver 110 receives the scan driving control signal SCS from the timing controller 150. The scan driver 110 that receives the scan driving control signal SCS generates scan signals and sequentially supplies the generated scan signals to the scan lines S1 to Sn. In addition, the scan driver 110 generates emission control signals in response to the scan driving control signal SCS and sequentially supplies the generated emission control signals to the emission control lines E1 to En. Here, the emission control signals are set to have a larger width than the scan signals. For example, the emission control signal supplied to the ith (i is a natural number) emission control line Ei overlaps the scan signals supplied to the (i−1)th and ith scan lines Si−1 and Si. In one embodiment, the emission control signal supplied to the (i+2)th emission control line Ei+2 overlaps with the scan signal supplied to the ith scan line Si in a partial period.

On the other hand, the scan signals are set to have voltages at which the transistors included in the pixels 140 may be turned on, for example, low voltage. The emission control signals are set to have voltages at which the transistors included in the pixels 140 may be turned off, for example, high voltages.

The data driver 120 receives the data driving control signal DCS from the timing controller 150. The data driver 120 that receives the data driving control signal DCS generates data signals and supplies the generated data signals to the data lines D1 to Dm in synchronization with the scan signals.

The pixel unit 130 receives a first power supply ELVDD and a second power supply ELVSS from the outside of the organic light emitting display and supplies the ELVDD and ELVSS to the pixels 140. The pixels 140 that receive the first power supply ELVDD and the second power supply ELVSS generate light components corresponding to the data signals, respectively. On the other hand, the pixel 140 positioned in an ith horizontal line is coupled to the (i−1)th and ith scan lines Si−1 and Si and the (n+2)th and nth emission control lines En+2 and En. For this purpose, the (n+1)th and nth emission control lines En+1 and En (not shown) and an $0^{th}$ scan line S0 are further formed in the pixel unit 130. Here, the structure of the emission control lines coupled to the pixels 140 may change to correspond to the pixels 140.

Figure 2:
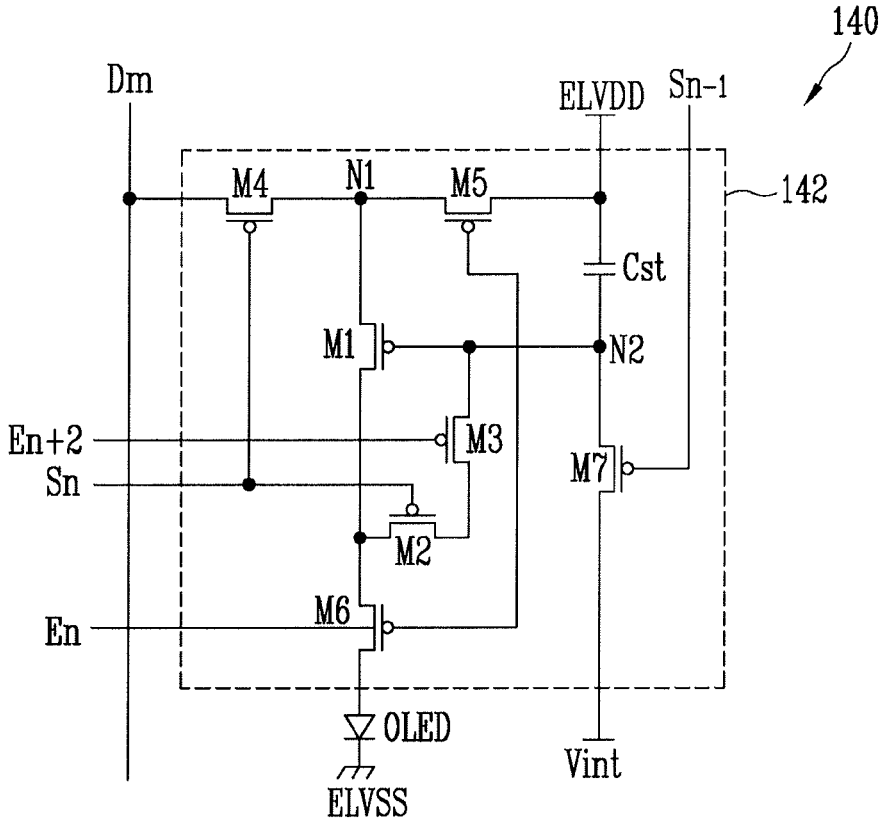
FIG. 2 is a circuit diagram of the pixel of FIG. 1 according to one embodiment.

FIG. 2 is a circuit diagram of the pixel of FIG. 1 according to one embodiment. In FIG. 2, for convenience sake, the pixel 140 coupled to the mth data line Dm, the nth scan line Sn, the (n−1)th scan line Sn−1, the nth emission control line En, and the (n+2)th emission control line En+2 will be illustrated.

Referring to FIG. 2, the pixel 140 includes an organic light emitting diode (OLED) and a pixel circuit 142 coupled to the data line Dm, the scan lines Sn-1 and Sn, and the emission control lines En and En+2 to control the amount of current supplied to the OLED.

The anode electrode of the OLED is coupled to the pixel circuit 142 and the cathode electrode of the OLED is coupled to the second power supply ELVSS. Here, the voltage value of the second power supply ELVSS is set to be lower than the voltage value of the first power supply ELVDD. The OLED generates light with predetermined brightness to correspond to the amount of current supplied from the pixel circuit 142.

The pixel circuit 142 controls the amount of current supplied to the OLED to correspond to the data signal supplied to the data line Dm when the scan signal is supplied to the scan line Sn. For this purpose, the pixel circuit 142 includes first to seventh transistors M1 to M7 and a storage capacitor Cst.

The first electrode of the fourth transistor M4 is coupled to the data line Dm and the second electrode of the fourth transistor M4 is coupled to a first node N1. The gate electrode of the fourth transistor M4 is coupled to the nth scan line Sn. The fourth transistor M4 is turned on when the scan signal is supplied to the nth scan line Sn to supply the data signals supplied to the data line Dm to the first node N1.

The first electrode of the first transistor M1 is coupled to the first node n1 and the second electrode of the first transistor M1 is coupled to the first electrode of the sixth transistor M6. The gate electrode of the first transistor M1 is coupled to a second node N2. The first transistor M1 supplies current corresponding to the voltage charged in the storage capacitor Cst to the OLED.

The first electrode of the second transistor M2 is coupled to the second electrode of the first transistor M1 and the second electrode of the second transistor M2 is coupled to the first electrode of the third transistor M3. The gate electrode of the second transistor M2 is coupled to the nth scan line Sn. The second transistor M2 is turned on when the scan signal is supplied to the nth scan line Sn to couple the second electrode of the first transistor M1 to the first electrode of the third transistor M3.

The first electrode of the third transistor M3 is coupled to the second electrode of the second transistor M2 and the second electrode of the third transistor M3 is coupled to the second node N2. The gate electrode of the third transistor M3 is coupled to the (n+2)th emission control line En+2. The third transistor M3 is turned off when the emission control signal is supplied to the (n+2)th emission control line En+2 and is turned on in the other cases. On the other hand, in the period where the second transistor M2 and the third transistor M3 are turned on, the first transistor M1 is coupled in the form of a diode.

The seventh transistor M7 is coupled between the second node N2 and an initializing power supply Vint. The gate electrode of the seventh transistor M7 is coupled to the (n−1)th scan line Sn−1. The seventh transistor M7 is turned on when the scan signal is supplied to the (n−1)th scan line to supply the voltage of the initializing power supply Vint to the second node N2. Here, the initializing power supply Vint is set to have a voltage lower than the data signal.

The first electrode of the fifth transistor M5 is coupled to the first power supply ELVDD and the second electrode of the fifth transistor M5 is coupled to the first node N1. The gate electrode of the fifth transistor M5 is coupled to the nth emission control line En. The fifth transistor M5 is turned off when the emission control signal is supplied to the nth emission control line En and is turned on when the emission control signal is not supplied.

The first electrode of the sixth transistor M6 is coupled to the second electrode of the first transistor M1 and the second electrode of the sixth transistor M6 is coupled to the anode electrode of the OLED. The gate electrode of the sixth transistor M6 is coupled to the nth emission control line En. The sixth transistor M6 is turned off when the emission control signal is supplied to the nth emission control line En and is turned on when the emission control signal is not supplied.

The storage capacitor Cst is coupled between the first power supply ELVDD and the second node N2. The storage capacitor Cst stores the data signal and a voltage corresponding to the threshold voltage of the first transistor M1.

Figure 3:
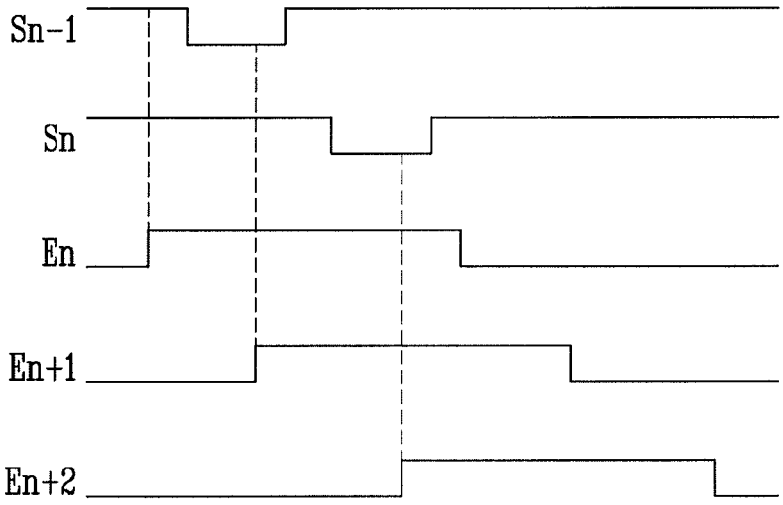
FIG. 3 illustrates driving waveforms supplied to the pixel of FIG. 2 according to one embodiment.

FIG. 3 illustrates driving waveforms supplied to the pixel of FIG. 2 according to one embodiment.

Referring to FIG. 3, the emission control signal is supplied to the nth emission control line En so that the fifth transistor M5 and the sixth transistor M6 are turned off. When the fifth transistor M5 is turned off, electrical coupling between the first power supply ELVDD and the first node N1 is blocked. When the sixth transistor M6 is turned off, electrical coupling between the second electrode of the first transistor M1 and the anode electrode of the OLED is blocked. Therefore, in the period where the emission control signal is supplied to the nth emission control line En, the pixel 140 is set in a non-emission state.

Then, the scan signal is supplied to the (n−1)th scan line Sn−1 so that the seventh transistor M7 is turned on. When the seventh transistor M7 is turned on, the voltage of the initializing power supply Vint is supplied to the second node N2.

After the initializing power supply Vint is supplied to the second node N2, the scan signal is supplied to the nth scan line Sn. When the scan signal is supplied to the nth scan line Sn, the second transistor M2 and the fourth transistor M4 are turned on. When the second transistor M2 is turned on, the second electrode of the first transistor M1 is coupled to the first electrode of the third transistor M3. At this time, since the third transistor M3 is turned on, the first transistor M1 is coupled in the form of a diode. When the fourth transistor M4 is turned on, the data signal is supplied from the data line Dm to the first node N1. At this time, since the second node N2 is initialized to the voltage of the initializing power supply Vint, the first transistor M1 coupled in the form of the diode is turned on.

Then, the data signal supplied to the first node N1 is supplied to the second node N2 via the first transistor M1 coupled in the form of the diode. At this time, the storage capacitor Cst stores the data signal and the voltage corresponding to the threshold voltage of the first transistor M1.

After a predetermined voltage is charged in the storage capacitor Cst, the emission control signal is supplied to the (n+2)th emission control line En+2. When the emission control signal is supplied to the (n+2)th emission control line, the third transistor M3 is turned off when the third transistor M3 is turned off, the voltage of the second node N2 is partially changed to correspond to the turning off of the third transistor M3.

After the third transistor M3 is turned off, supply of the scan signal to the nth scan line Sn is stopped so that the fourth transistor M4 and the second transistor M2 are turned off. At this time, since the third transistor M3 is turned off, although the second transistor M2 is turned off, the voltage of the second node N2 is not changed.

Then, supply of the emission control signal to the nth emission control line En is stopped so that the fifth transistor M5 and the sixth transistor M6 are turned on. When the fifth transistor M5 and the sixth transistor M6 are turned on, a current path is formed from the first power supply ELVDD to the OLED via the first transistor M1.

After the supply of the emission control signal to the nth emission control line En is stopped, supply of the emission control signal to the (n+2)th emission control line En+2 is stopped. When the supply of the emission control signal to the (n+2)th emission control line En+2 is stopped, the third transistor M3 is turned on. At this time, the voltage of the second node N2 is partially changed to correspond to the turning on of the third transistor M3.

Here, after the predetermined voltage is charged in the storage capacitor Cst, the voltage of the second node N2 is changed in response to the turning off and on of the third transistor M3. In this case, theoretically, a first voltage corresponding to the turning off of the third transistor M3 is offset by a second voltage corresponding to the turning on of the third transistor M3 (that is, the first voltage=the second voltage) so that the second node N2 maintains a predetermined voltage. In one embodiment, after the voltage is charged in the storage capacitor Cst, the third transistor M3 is turned off and on so that it is possible to prevent the voltage of the second node N2 from being changed.

Then, the first transistor M1 controls the amount of current supplied from the first power supply ELVDD to the OLED in response to the voltage applied to the second node N2. In this case, the pixels 140 may realize an image with desired brightness and the pixel unit 130 may display an image with uniform brightness.

Figure 4:
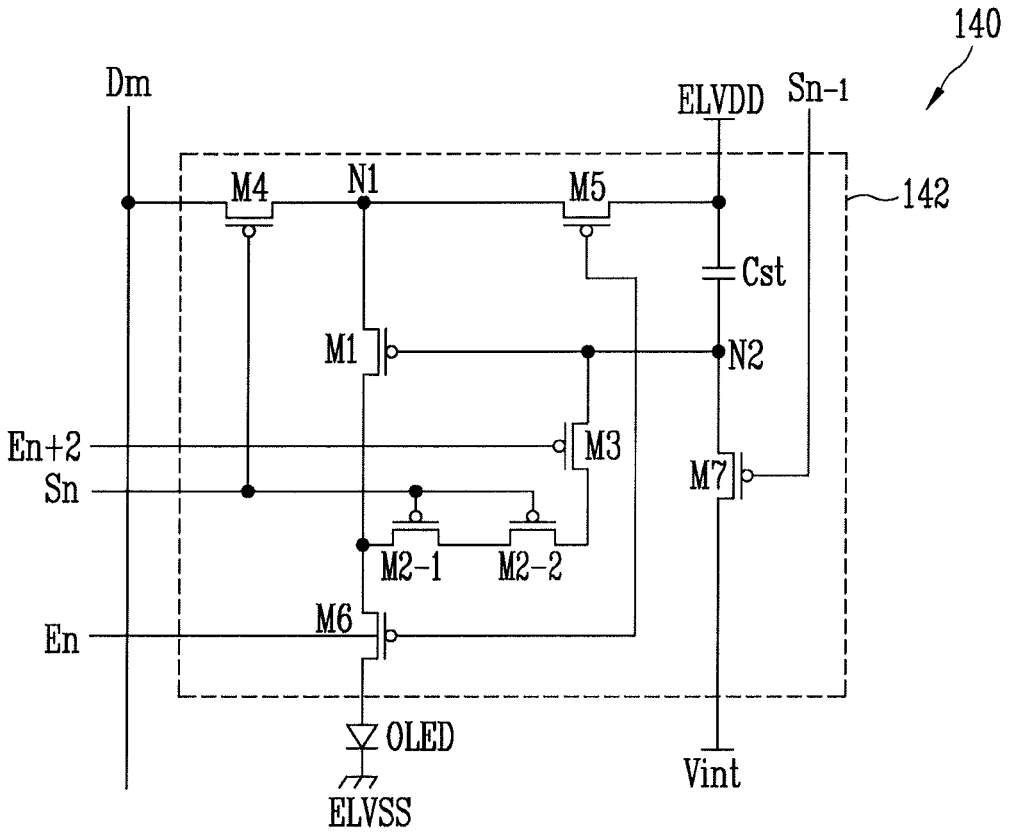
FIG. 4 is a circuit diagram of the pixel of FIG. 1 according to another embodiment.

A plurality of transistors including the third transistor M3 may be formed between the gate electrode and the second electrode of the first transistor M1. For example, as illustrated in FIG. 4, a plurality of second transistors M2_1 and M2_2 may be formed between the third transistor M3 and the second electrode of the first transistor M1. At this time, since the third transistor M3 is turned off before the second transistors M2_1 and M2_2 are turned off and is turned on after the second transistors M2_1 and M2_2 are turned off, it is possible to prevent the voltage of the second node N2 from changing regardless of the second transistors M2_1 and M2_2.

In one embodiment, the third transistor M3 is coupled to the (n+2)th emission control line En+2. The third transistor M3 may be coupled to an additional signal line so that the third transistor M3 is turned off before the second transistor M2 is turned off and is turned on after the second transistor M2 is turned off.

According to at least one of the disclosed embodiments, after a predetermined voltage is charged in the storage capacitor, transistors for coupling a driving transistor in the form of a diode are sequentially turned off and on. In this case, a voltage change generated by turning off the transistors is offset by a voltage change generated by turning on the transistors so that the voltage stored in the storage capacitor can be stably maintained.

Furthermore, the voltage charged in the storage capacitor may be stably maintained regardless of the transistors for coupling the driving transistor in the form of the diode so that an image with uniform brightness may be displayed.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED) comprising an anode electrode;

a first transistor comprising i) first and second electrodes and ii) a gate electrode, wherein the second electrode is operatively coupled to the anode electrode of the OLED, and wherein the first transistor is configured to control an amount of current supplied to the OLED in response to a voltage applied to the gate electrode;

at least one second transistor operatively coupled between the second electrode and the gate electrode of the first transistor; and a third transistor directly coupled to the second transistor and the gate electrode of the first transistor, wherein the third transistor comprises i) a gate electrode and ii)) first and second electrodes respectively directly connected to the gate electrode of the first transistor and the second transistor, and wherein the third transistor is configured to be partially turned off during part of a period in which the second transistor is turned on.

2. The pixel as claimed in claim 1, wherein the third transistor is configured to be turned on when the second transistor is turned on.

3. The pixel as claimed in claim 2, wherein the third transistor is configured to be turned off before the second transistor is turned off.

4. The pixel as claimed in claim 3, wherein the third transistor is configured to be turned on after the second transistor is turned off.

5. The pixel as claimed in claim 1, wherein the first transistor is connected in parallel with the second and third transistors.

6. A pixel, comprising:

an organic light emitting diode (OLED) comprising an anode electrode;

a first transistor comprising i) first and second electrodes and ii) a gate electrode, wherein the second electrode is operatively coupled to the anode electrode of the OLED, and wherein the first transistor is configured to control an amount of current supplied to the OLED in response to a voltage applied to the gate electrode;

at least one second transistor operatively coupled between the second electrode and the gate electrode of the first transistor; and a third transistor operatively coupled between the second transistor and the gate electrode of the first transistor, wherein the third transistor is configured to be partially turned off during part of a period in which the second transistor is turned on, wherein the pixel further comprises:

a fourth transistor operatively coupled between a data line and the first electrode of the first transistor and configured to be substantially simultaneously turned on and off with the second transistor;

a fifth transistor operatively coupled between the first electrode of the first transistor and a first power supply and configured to be turned off in a period where the second transistor is turned on;

a sixth transistor operatively coupled between the second electrode of the first transistor and the OLED and configured to be substantially simultaneously turned on and off with the fifth transistor;

a seventh transistor operatively coupled between an initializing power supply and the gate electrode of the first transistor and configured to be turned on before the second transistor is turned on; and a storage capacitor operatively coupled between the gate electrode of the first transistor and the first power supply.

7. An organic light emitting display, comprising:

a scan driver configured to drive a plurality of scan lines and a plurality of emission control lines;

a data driver configured to drive a plurality of data lines; and a plurality of pixels positioned at intersections of the scan lines and the data lines, wherein each of the pixels positioned in an ith (i is a natural number) horizontal line comprises:

an organic light emitting diode (OLED);

a first transistor comprising i) first and second electrodes and ii) a gate electrode, wherein the second electrode is operatively coupled to the OLED, and wherein the first transistor is configured to control an amount of current supplied to the OLED in response to a voltage applied to the gate electrode;

a second transistor operatively coupled between the second electrode and the gate electrode of the first transistor and configured to be turned on when a scan signal is supplied to an ith scan line; and a third transistor operatively coupled between the second transistor and the gate electrode of the first transistor and configured to be turned on except when an emission control signal is supplied to an (i+2)th emission control line, wherein the scan driver is configured to supply an emission control signal to an ith emission control line to at least partially overlap with scan signals supplied to (i−1)th and ith scan lines.

8. The organic light emitting display as claimed in claim 7, wherein the scan driver is configured to supply the emission control signal to the (i+2)th emission control line to overlap with the scan signal supplied to the ith scan line in a partial period.

9. The organic light emitting display as claimed in claim 7, wherein a turn on period of the third transistor at least partially overlaps with a turn on period of the second transistor in response to the emission control signal supplied to the (i+2)th emission control line, and wherein the third transistor is configured to be turned off before the second transistor is turned off.

10. The organic light emitting display as claimed in claim 9, wherein the third transistor is configured to be turned on after the second transistor is turned off.

11. The organic light emitting display as claimed in claim 7, wherein each of the pixels positioned in the ith horizontal line comprises:

a fourth transistor operatively coupled between the corresponding data line and the first electrode of the first transistor and comprising a gate electrode coupled to the ith scan line;

a fifth transistor operatively coupled between the first electrode of the first transistor and a first power supply and comprising a gate electrode coupled to the ith emission control line;

a seventh transistor operatively coupled between an initializing power supply and the gate electrode of the first transistor and comprising a gate electrode coupled to the (i−1)th scan line; and a storage capacitor operatively coupled between the gate electrode of the first transistor and the first power supply.

12. The organic light emitting display as claimed in claim 11, wherein the initializing power supply has a lower voltage than the data signal supplied to the data line.

* * * * *